United States Patent [19]

Justus

[11] 4,158,596

[45] Jun. 19, 1979

[54] TRAVELING WIRE WEB FORMER

[75] Inventor: Edgar J. Justus, Beloit, Wis.

[73] Assignee: Beloit Corporation, Beloit, Wis.

[21] Appl. No.: 804,512

[22] Filed: Jun. 8, 1977

[51] Int. Cl.[2] ..... D21F 9/02

[52] U.S. Cl. ..... 162/213; 162/217; 162/292; 162/297; 162/299; 162/301; 162/317; 162/339

[58] Field of Search ..... 162/132, 203, 212, 213, 162/217, 289, 292, 298, 299, 301, 317, 337, 339, 352, DIG. 7

[56] References Cited

U.S. PATENT DOCUMENTS

| | | | |
|---|---|---|---|
| 2,062,445 | 12/1936 | Charlton | 162/299 |
| 3,642,573 | 2/1972 | Genz et al. | 162/317 |
| 3,994,774 | 11/1976 | Halme et al. | 162/352 |

FOREIGN PATENT DOCUMENTS

| | | | |
|---|---|---|---|
| 328191 | 10/1920 | Fed. Rep. of Germany | 162/292 |

*Primary Examiner*—S. Leon Bashore
*Assistant Examiner*—William F. Smith
*Attorney, Agent, or Firm*—Hill, Van Santen, Steadman, Chiara & Simpson

[57] ABSTRACT

An apparatus and method of forming a continuous fibrous paper web by depositing the stock onto a forming run of a fourdrinier wire while dewatering the stock and collecting water beneath the wire and depositing the stock onto the wire from a spray or flooded area through a distribution wire extending parallel and in closely spaced relation to the forming run of the fourdrinier wire with the distribution wire aiding in the distribution of the stock and random orientation of the fibers and giving the stock a velocity essentially the same as the forming wire to encourage and maintain the random orientation of the fibers as droplets of the stock are deposited on the fourdrinier wire.

14 Claims, 2 Drawing Figures

TRAVELING WIRE WEB FORMER

BACKGROUND OF THE INVENTION

Figures 1, 2:
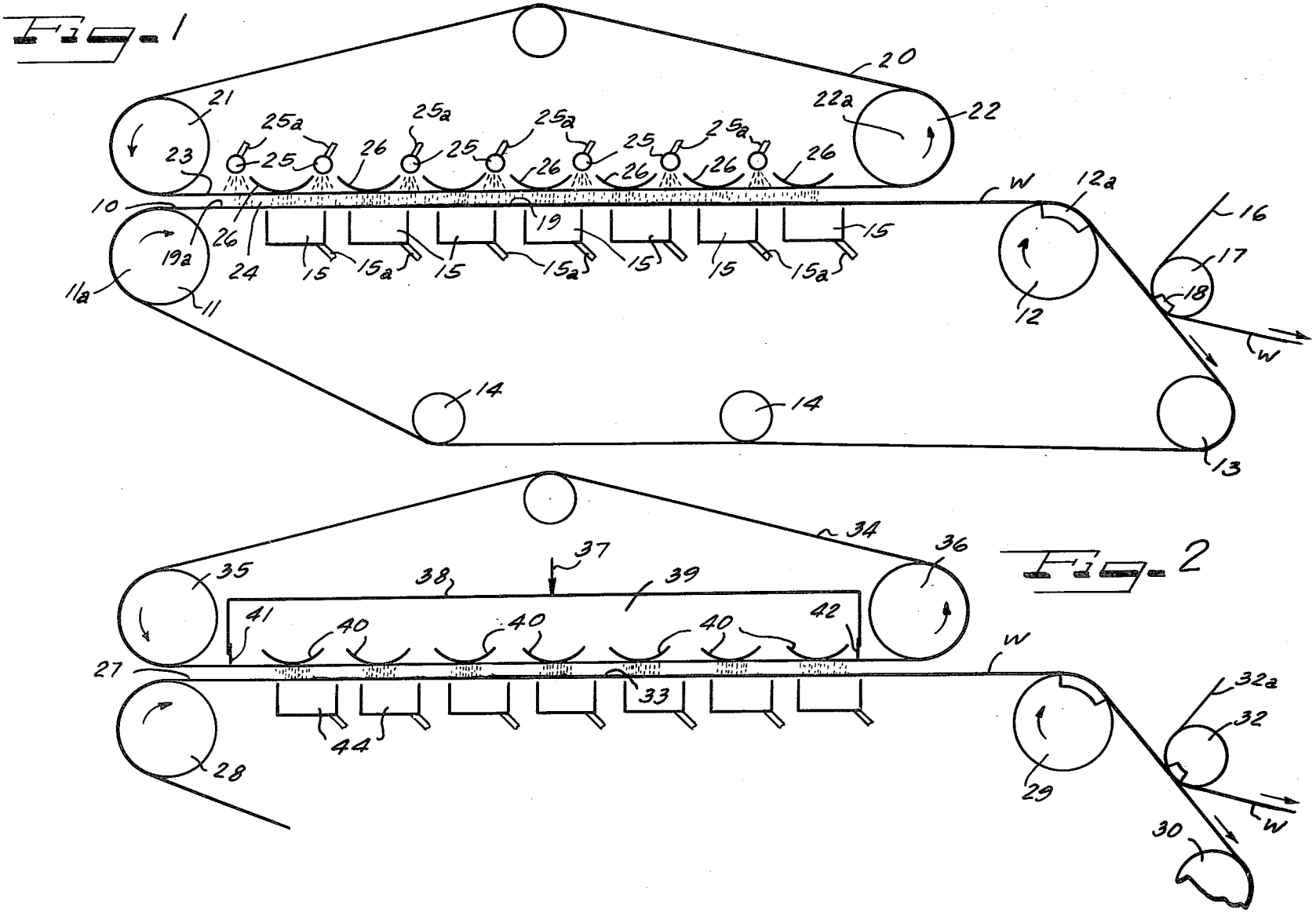

The present invention relates to improvements in web forming machines and more particularly, machines that are well adapted to forming a continuous web of paper from a slurry of stock deposited on the surface thereof and dewatered through the wire.

In the high speed formation of paper, a stock slurry is commonly deposited onto a traveling fourdrinier wire with the slurry dewatering through the wire surface and the fibers forming a web on the upper forming surface of the wire. Essential to the formation of a good web is the random orientation of the fibers so that the web has good formation and the fibers have uniform distribution and orientation and interlock forming a paper web which is uniform in appearance and strength. Such uniformity is advantageous and beneficial to substantially all of the properties of the paper web in that it improves strength and appearance, receptivity to ink and makes it possible to form a web of good quality with shorter and less expensive fibers than are necessary if random orientation of the fibers is not attained.

Machine design efforts have gone to great length to attain the uniformity of distribution and direction of the fibers and to maintain this random orientation as the stock slurry is deposited onto the web. In a conventional fourdrinier machine wherein the stock is deposited onto the beginning of a forming zone on a fourdrinier wire through an open slice from a headbox, limitations are encountered in that differences in velocity between the traveling fourdrinier wire and the spouting jet of stock will affect the orientation of the fibers and they tend to cause them to align predominantly in the direction of wire travel, or to tend to shift to extend in a cross-machine direction. Such variations will affect the machine direction versus cross direction strength ratio of the paper and an objective in controlled operation of a forming machine is to control the MD/CD ratio usually to attempt to attain a ratio of unity which achieves what is known as a square sheet.

An object of the present invention is to provide a new method and apparatus for forming a paper web wherein the fiber containing stock slurry is distributed onto a traveling forming surface in a unique manner.

A further object of the invention is to provide a machine for forming a continuous web from a slurry of stock wherein the random distibution and orientation of the fibers is improved, and improved control is obtained over a range of speeds of the traveling forming surface.

A still further object of the invention is to provide a method and apparatus for forming a web on a traveling fourdrinier wire with improved means for distributing the stock onto the wire obtaining a greater control over the quantity of stock supplied to the wire and better control over the manner in which the stock is evenly distributed onto the wire for improved formation and better drainage.

Other objects and advantages and features, as well as equivalent methods and apparatuses which are intended to be covered herein, will become more apparent with the teaching of the principles of the invention in connection with the disclosure of the preferred embodiments in the specification, claims and drawings, in which:

DRAWINGS

FIG. 1 is a side elevational view in schematic form illustrating an apparatus operating in accordance with the principles of the invention; and FIG. 2 is another side schematic elevational view illustrating another form of the invention.

DESCRIPTION

As illustrated in FIG. 1, a looped traveling fourdrinier wire 10 is arranged to be supported by a breast roll 11 and a couch roll 12 with a suction gland **12*a* therein. The wire passes over the breast roll 11 and travels along a horizontal forming run 19 with dewatering devices preferably in the form of suction boxes 15 positioned beneath the wire in the forming run to draw water downwardly through the fibers deposited on the upper surface of the wire. A web W will form on the upper surface of the wire and follow the fourdrinier wire to a pick-up location wherein the web is removed by a pick-up wire 16 passing over a pick-up 17 with a suction gland 18 therein. The fourdrinier wire passes over a turning roll 13 and over guide rolls 14 back to the couch roll 11**.

The dewatering devices 15 may take various forms such as table rolls or foils, but suction boxes are preferably used and can be individually regulated to increase the dewatering suction applied through the wire to the web in the direction of the forming run 19.

In accordance with the present invention, the stock which is deposited on the wire to form the web is not discharged at a single location as is conventional with a headbox and slice opening but is distributed onto the wire for some distance from the beginning of the forming run along the forming run. Thus, at location **19*a* only a small amount of stock is delivered onto the forming wire so that dewatering will be begun and web formation start, and additional stock is deposited continually onto the forming run, on top of the web already forming, for substantially the full length of the forming run. In some instances, this will improve formation in that the lower layers of the web will have begun to form when upper more wet layers are deposited so that the fibers aligned in their random formation will tend to retain their random formation because optimum dewatering begins immediately. The optimum rate of dewatering can be augmented by the graduation of increased suction along the bottom of the web, and for this purpose, the individual suction lines 15*a*** to the suction boxes can be under individual control such as by shut-off valves or by control of the vacuum applied thereto.

Above the forming run of the fourdrinier wire is a distribution wire 20. The distribution wire is trained over supporting rolls with the lower rolls shown at 21 and 22 positioned so that the distribution run 23 of the wire 20 will extend in parallel close running relation to the forming run of the fourdrinier wire with a small space 24 therebetween. The distribution wire 20 is driven, as is the fourdrinier wire, and will travel at essentially the same speed as the fourdrinier wire. In some instances, it may be desirable to relatively control the speed of the distribution wire to give it a speed slightly less or slightly more than the fourdrinier wire to attain optimum control of the orientation of the fibers. Primarily the fibers will be randomly distributed, and an increase in speed of the distribution wire over that of the fourdrinier wire will tend to align the fibers in the direction of the web to increase the machine direction strength.

Principally, the distribution wire provides a means for imparting a velocity to the droplets of stock and to cause them to travel at the same speed and direction as the fourdrinier wire so that the random orientation of the fibers is not disturbed as they are deposited on the fourdrinier wire. The distribution wire is foraminous and preferably has larger openings than the fourdrinier wire and constructed of plastic or material that insures easy passage of the fibrous stock through the distribution wire onto the forming wire.

For supplying the stock, a plurality of sprays 25 are positioned above the distribution wire to discharge the stock downwardly through the distribution wire onto the fourdrinier wire. The sprays extend so that the stock is uniformly distributed across the forming run of the fourdrinier wire, and also arranged so that the stock is continued to be deposited for at least a portion of the forming run. Thus, at each location along the forming run, only a small amount of stock passes downwardly which easily passes through the distribution wire onto the fourdrinier wire to begin dewatering and begin formation of the web. The sprays 25 are shown as individual spray tubes with spray openings therealong, and these tubes may be fed from a common manifold or from individual lines such as **25*a*** and may be individually controlled by valving means so that the quantity and pressure of each of the sprays can be varied in accordance with operating conditions. In certain circumstances, it may be desirable to supply different grades of stock at different locations along the forming run. For example, a long fibered stock may be supplied at the beginning of the forming run to prevent drainage of the fibers through the fourdrinier wire and shorter fibers and fines delivered further along the forming run. These fines will be retained by the web which has already begun forming on the fourdrinier wire. This makes it possible to form a quality web using a greater proportion of fines. In the ordinary delivery of stock by means of a headbox, the short and long fibers and fines must be uniformly distributed through the stock so that in the initial stages of formation, fines are lost through the fourdrinier wire on the lower surface of the web. This can be better controlled with the present arrangement by having less fines in the initial stock that is delivered downwardly onto the wire and a greater proportion of fines later on. Also, the last quantity of stock delivered may also contain higher quality long fibers so that the web in essence is a sandwich arrangement with shorter fibers sandwiched between longer fibers at the bottom and top surface of the web.

To aid in the passage of the stock through the distribution wire, means are provided to force the stock therethrough as shown in the form of foils 26. These foils have a rounded nose on the oncoming side so that a downward pressure is applied to the stock forcing it rapidly through the distribution wire. The droplets of stock coming down from the spray above are picked up by the distribution wire and carried along at the speed of the distribution wire so that by the time they pass through the distribution wire, they will have attained the velocity of the fourdrinier wire and will pile onto the fourdrinier wire with the fibers retaining their random orientation. That is, engagement between the droplets and the fourdrinier wire will not tend to string out the fibers and cause them to align in the machine direction.

The speed control of the distribution wire could be obtained by control of the speed of the power input drive shaft **22*a* connected to the driving roll of the distrubtion wire. Similarly, the fourdrinier wire can be driven by drive shaft 11*a*** driving the breast roll, and as will be appreciated by those versed in the art, different drive arrangements may be employed.

In summary of operation, a fiber containing stock slurry is sprayed downwardly from nozzle jets 25, in a controlled manner, downwardly against a distribution wire 20. The distribution wire has a lower run 23 which travels in parallel close running spaced relation to the forming run 19 of the fourdrinier wire. The fibers of the stock slurry are forced downwardly through the distribution wire 20 by curved foils 26 and the droplets are carried forwardly at the velocity of the fourdrinier forming wire so that the fibers retain their random orientation as they are deposited onto the upper surface of the forming wire.

The foils should be curved at their oncoming side, and can be formed square shaped on the trailing side. However, also they may be curved away from the wire on the trailing side, as shown, which reduces the length of the foil in contact with the wire and helps maintain the upper wire clean.

FIG. 2 illustrates another form of the invention wherein a lower fourdrinier wire 27 is supported on a breast roll 28 and a couch roll 29 and passes down over a turning roll 30. The finished web W is picked off the fourdrinier wire by a pickup felt **32*a* passing down a pickup roll 32. Above the fourdrinier wire is a distribution wire 34 supported on spaced rolls 35 and 36 so as to run in parallel close running relationship with the forming run of the fourdrinier wire. Beneath the fourdrinier wire is suction boxes 44**.

Stock is distributed onto the fourdrinier wire through the distribution wire which functions to move the stock droplets in the direction and at the velocity of the fourdrinier wire. The stock is passed through the distribution wire 34 by providing a flooded area above the distribution wire. To provide this flooded area, a stock box 38 having a hollow chamber 39 therein is positioned above the wire and stock is flooded into the box through an inlet supply line 37. Seals 41 and 42 are provided at the leading and trailing end of the box to hold the pool of stock therein. Foils 40 extend across the width of the wire within the box to force the stock down through the distribution wire. Control of the amount of stock passed through the distribution wire can be attained by varying the flow of stock into the box through the supply line 37, and the height of the stock within the box. As the distribution wire 34 travels along at essentially the same speed as the fourdrinier wire, it will drag the stock forwardly onto the foils which will force the stock down through the distribution wire and will pass downwardly in droplets onto the fourdrinier wire with good fiber orientation, and there will be no increment of velocity which will tend to destroy the fiber orientation to cause the fibers to trail in the machine direction or tend to realign in a crossmachine direction.

Thus, it will be seen that I have provided a unique and improved method and apparatus for forming a continuous fibrous web from a fiber containing stock slurry which achieves the objects and advantages hereinabove set forth and provides for improved variation and flexibility in control of operation and attains a possibility of the production of a web of improved quality.

I claim as my invention:

1. An apparatus for forming a continuous web from a slurry of fiber containing stock comprising in combination:

an open porous looped traveling fourdrinier wire for traveling along a web forming path;

dewatering devices beneath the wire arranged along said path;

a looped distribution wire positioned to travel above said fourdrinier wire in parallel close running spaced relation thereto along said forming path in the same direction and substantially at the same speed having openings larger than the fourdrinier wire so that the fibers of the slurry pass therethrough and are carried forwardly at the speed of the fourdrinier wire and are random oriented so that the random orientation is not disturbed by the fiber being deposited on the moving fourdrinier wire;

stock delivery means positioned above and within the distribution wire for delivery of stock uniformly across and onto the distribution wire;

and forcing means above and within the distribution wire and separate from the stock delivery means forcing stock into the distribution wire to be carried therewith at the speed of the distribution wire and through the wire.

2. An apparatus for forming a continuous web from a slurry of fiber containing stock constructed in accordance with claim 1 wherein:

the stock delivery means is in the form of spray nozzles uniformly arranged across the width of the fourdrinier wire and extending in the direction of the forming run.

3. An apparatus for forming a continuous web from a slurry of fiber containing stock constructed in accordance with claim 1 wherein:

said forcing means has means for positively mechanically vertically displacing and forcing the stock through said distribution wire toward the fourdrinier wire.

4. An apparatus for forming a continuous web from a slurry of fiber containing stock constructed in accordance with claim 1 wherein:

said forcing means is in the form of foils positioned in close running engagement with the distribution wire having curved leading surfaces so that the stock is positively forced down through the distribution wire.

5. An apparatus for forming a continuous web from a slurry of fiber containing stock constructed in accordance with claim 1 wherein:

said stock delivery means is in the form of a slurry containing chamber having an opening facing the distribution wire and having means for maintaining a pond of stock therein.

6. An apparatus for forming a continuous web from a slurry of fiber containing stock comprising in combination:

an open porous dewatering foraminous member having a forming surface and arranged for traveling along a web forming path and draining water through the surface forming a fibrous web from a fiber containing slurry;

means for collecting water drained from the slurry through the surface;

stationary stock depositing means positioned opposite the surface for depositing stock slurry onto the surface;

distribution means between the depositing means and the surface separate from said depositing means and spaced from said forming surface for positively physically imparting a velocity of the stock in the direction of movement of said surface essentially the same as said surface so that random orientation of stock fibers is retained as the stock engages the moving surface said fibers passing through said distribution means and onto said porous dewatering foraminous member and means separate from said depositing means and above the distribution means insuring the movement of the stock with said distribution means to insure the imparting of said velocity.

7. An apparatus for forming a continuous web from a slurry of fiber containing stock constructed in accordance with claim 6 wherein:

said porous dewatering foraminous member is in the form of a looped fourdrinier wire.

8. An apparatus for forming a continuous web from a slurry of fiber containing stock constructed in accordance with claim 7 wherein:

said distribution means is an open looped wire having openings larger than the fourdrinier wire and positioned in close parallel spaced running relation to the fourdrinier wire.

9. An apparatus for forming a continuous web from a slurry of fiber containing stock constructed in accordance with claim 6 wherein:

the depositing means is in the form of a spray for uniformly spraying the stock slurry onto the forming surface.

10. An apparatus for forming a continuous web from a slurry of fiber containing stock constructed in accordance with claim 6 wherein:

the depositing means extends uniformly across the forming surface and in the direction of travel thereof.

11. An apparatus for forming a continuous web from a slurry of fiber containing stock constructed in accordance with claim 6 wherein:

said distribution means is in the form of a container maintaining a flooded area of stock slurry in contact with the distribution means.

12. The method of continuously forming a web from a slurry of fiber containing stock in a mechanism having a continuously moving traveling fourdrinier wire traveling along a web forming path, means collecting water beneath the wire removed from a slurry on the wire surface, the method comprising;

uniformly distributing a supply of fiber containing slurry onto the traveling wire by passing an upper wire parallel to the fourdrinier wire but out of contact therewith at the speed of the fourdrinier wire;

distributing stock across the upper wire at locations spaced apart in a downstream direction;

and forcing the distributed stock onto the upper wire by means separate from the means that distributes the stock so that the stock passes through the upper wire onto the fourdrinier wire and travels at the speed of the upper wire and the fourdrinier wire.

13. A method for forming a continuous web from a slurry of fiber containing stock in accordance with the steps of claim 12 wherein:

the stock is distributed onto the traveling wire in a spray covering an area extending uniformly across the wire and for a distance in the direction of the forming run.

14. A method for forming a continuous web from a slurry of fiber containing stock in accordance with the steps of claim 12 wherein:

the stock is distributed onto the fourdrinier wire by maintaining a flooded area of stock slurry across the wire and in the direction of wire travel with the stock fed from the flooded area to directly attain the velocity of the fourdrinier wire before engaging the fourdrinier wire.

* * * * *